US010534299B2

(12) United States Patent
Kobayashi

(10) Patent No.: US 10,534,299 B2
(45) Date of Patent: Jan. 14, 2020

(54) IMAGE FORMING APPARATUS REDUCING TIME TAKEN FOR MEASURING DENSITY OF PATCH IMAGE

(71) Applicant: CANON KABUSHIKI KAISHA, Tokyo (JP)

(72) Inventor: Masaki Kobayashi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/043,699

(22) Filed: Jul. 24, 2018

(65) Prior Publication Data

US 2019/0033764 A1 Jan. 31, 2019

(30) Foreign Application Priority Data

Jul. 31, 2017 (JP) ..... 2017-147437

(51) Int. Cl.
*G03G 15/00* (2006.01)

(52) U.S. Cl.
CPC ..... *G03G 15/5058* (2013.01); *G03G 2215/00037* (2013.01)

(58) Field of Classification Search
CPC ..... G03G 15/5058
USPC ..... 399/49
See application file for complete search history.

(56) References Cited

U.S. PATENT DOCUMENTS

| | | | | |
|---|---|---|---|---|
| 7,327,977 | B2 | 2/2008 | Kitazawa et al. | |
| 9,031,428 | B2 | 5/2015 | Fujimori et al. | |
| 2009/0220263 | A1* | 9/2009 | Murayama | G03G 15/0194 399/49 |
| 2013/0022377 | A1* | 1/2013 | Sugeta | G03G 15/0189 399/301 |
| 2013/0051827 | A1* | 2/2013 | Fukumuro | G03G 15/5058 399/49 |

FOREIGN PATENT DOCUMENTS

| | | | |
|---|---|---|---|
| JP | 2006-162652 | A | 6/2006 |
| JP | 2007-292855 | A | 11/2007 |
| JP | 2010-276854 | A | 12/2010 |
| JP | 2013-125154 | A | 6/2013 |

* cited by examiner

*Primary Examiner* — Quana Grainger
(74) *Attorney, Agent, or Firm* — Venable LLP

(57) ABSTRACT

The image forming apparatus determines, based on a determination value calculated by a calculating unit, a light amount of reflection light from a first position on an image bearing member from light amounts of reflection light beams from a second position and a third position on the image bearing member where a patch image is not formed in a state where the patch image is formed at the first position on the image bearing member, or determines the light amount of reflection light from the first position on the image bearing member by detecting the light amount of reflection light from the first position on the image bearing member with a detecting unit in a state where the patch image is not formed at the first position on the image bearing member.

16 Claims, 9 Drawing Sheets

FIG. 9

PERIPHERAL LENGTH OF INTERMEDIATE TRANSFER BELT

| | AREA 1 | AREA 2 | AREA 3 | AREA 4 |
|---|---|---|---|---|
| POSITION ON INTERMEDIATE TRANSFER BELT | | | | |
| WAVE LENGTH REGION WIDTH OF REFLECTION LIGHT OF BASE SURFACE ELEMENT X2 | SMALL | | LARGE | |
| FREQUENCY OF REFLECTION LIGHT AMOUNT VARIATION OF BASE SURFACE ELEMENT X3 | LOW | HIGH | LOW | HIGH |
| CAUSABILITY OF SCRATCH OR SMEAR X4 | LOW | | HIGH | LOW |
| CALCULATION METHOD OF BASE SURFACE ELEMENT UNDER PATCH | SAMPLING FREQUENCY : LOW PREDICTION METHOD : LINEAR INTERPOLATION | SAMPLING FREQUENCY : LOW PREDICTION METHOD : POLYNOMINAL INTERPOLATION | (HARDLY PREDICTED) USE MEASUREMENT DATA OF BASE SURFACE ELEMENT | SAMPLING FREQUENCY : HIGH PREDICTION METHOD : POLYNOMINAL INTERPOLATION |

IMAGE FORMING APPARATUS REDUCING TIME TAKEN FOR MEASURING DENSITY OF PATCH IMAGE

BACKGROUND OF THE INVENTION

Field of the Invention

The present invention relates to an image forming apparatus based on electrophotography, such as a laser beam printer, a copying machine, and a facsimile machine.

Description of the Related Art

In an electrophotographic image forming apparatus, a density of a formed image varies depending on conditions of temperature and humidity of a usage environment and a usage degree of process stations. In such an image forming apparatus, the image density is controlled to compensate for the variations. The image forming apparatus forms a patch image for a density measurement of colors on a photosensitive member on which an image is formed, on an intermediate transfer belt on which the image formed on the photosensitive member is transferred, and an electrostatic adherence conveyance belt for conveying a sheet on which the image is transferred. A density of the formed patch image (also referred to as a patch) is measured by a density sensor. Based on a result of the measurement, feedback is provided to process forming conditions such as a laser light amount of an exposure device and adjustment of high voltages to be applied to members. In this manner, the image forming apparatus adjusts a maximum density of toner and a halftone property for each process station In general, a density sensor includes a light emitting unit and a light receiving unit. The light emitting unit applies a light beam to a formed patch for a density measurement, and a light amount of reflection light from the patch is detected by a light receiving sensor of the light receiving unit. Based on the detected light amount of the reflection light, the feedback is given to the process forming conditions. Sensing systems of the density sensor are roughly categorized into two systems: one for detecting irregular reflection components of reflection light, and the other for detecting regular reflection components of reflection light. In the method for detecting irregular reflection components, components of reflected light that are perceived as colors are detected. The method is therefore suitable for sensing chromatic color toners (e.g. yellow, etc.) other than a black toner but unsuitable for sensing the black toner. In contrast, a system of detecting regular reflection components mainly detects reflection light from a base surface where a patch is formed. Therefore, a density detection can be performed regardless of a color of toner and a color of the base surface where the patch is formed. In a case of using a density sensor of a regular reflection light detection type mainly detecting reflection light from a base surface, when a surface condition of an intermediate transfer belt where a patch is formed changes due to a degree of usage of the intermediate transfer belt or the electrostatic adherence conveyance belt, the light amount of regular reflection light from the patch also varies. Hence, for example, Japanese Patent Application Laid-Open No. 2007-292855 describes that conversion into density information after dividing a light amount of reflection light of a patch for a density measurement by a light amount of reflection light of the base surface to calculate a ratio (hereafter, also referred to as base surface compensation) is effective. Measurement of the light amount of reflection light from the base surface for the base surface compensation is desirably performed at the same timing as a timing for creating the patch for a density measurement and at the same position as a position of the patch for a density measurement, in consideration of material unevenness or aging of the electrostatic adherence conveyance belt or the intermediate transfer belt.

However, in the measurement of the light amount of reflection light from the base surface for the base surface compensation, measurement over at least a peripheral length of the electrostatic adherence conveyance belt or the intermediate transfer belt (a length of an entire periphery) needs to be performed before creation of the patch for a density measurement. Therefore, a problem exists in that a time taken for a density measurement of the patch becomes long. Hence, there is a method in which a light amount of reflection light of a base surface is measured and saved at factory shipment or the like, and measurement of a light amount of reflection light of the base surface in a density measurement of a patch is omitted by referring to the saved light amount of reflection light of the base surface. However, the light amount of reflection light of the base surface measured at factory shipment or the like is a measured value for a new intermediate transfer belt or electrostatic adherence conveyance belt. Therefore, the light amount cannot support aging due to the material unevenness or the degree of usage of the electrostatic adherence conveyance belt or the intermediate transfer belt. As a result, there is a risk that an accuracy of the density measurement may decrease with time.

SUMMARY OF THE INVENTION

An aspect of the present invention is an image forming apparatus reducing a time taken for measuring a density while maintaining an accuracy of the measurement.

Another aspect of the present invention is directed to an image forming apparatus including an image bearing member; an image forming unit configured to form a patch image on the image bearing member; a detecting unit including a light emitting unit configured to emit light toward a light emitted portion being the image bearing member or the patch image, and a light receiving unit configured to receive reflection light from the light emitted portion; a calculating unit configured to calculate a determination value for determining a surface condition of the image bearing member; and a controlling unit configured to determine a value regarding a density of the patch image, based on a light amount of reflection light from the patch image formed at a first position and a light amount of reflection light from the first position on the image bearing member, wherein the controlling unit determines, based on the determination value calculated by the calculating unit, a light amount of reflection light from the first position on the image bearing member from light amounts of reflection light beams from a second position and a third position on the image bearing member where the patch image is not formed in a state in which the patch image is formed at the first position on the image bearing member, or determines the light amount of reflection light from the first position on the image bearing member by detecting the light amount of reflection light from the first position on the image bearing member with the detecting unit in a state in which the patch image is not formed at the first position on the image bearing member.

Further features of the present invention will become apparent from the following description of exemplary embodiments with reference to the attached drawings.

BRIEF DESCRIPTION OF THE DRAWINGS

FIG. 9 is a diagram illustrating a calculation method of a light amount of reflection light from a base surface element under a patch according to a position on an intermediate transfer belt in the embodiment 3.

DESCRIPTION OF THE EMBODIMENTS

Preferred embodiments of the present invention will now be described in detail in accordance with the accompanying drawings.

Embodiment 1

[Configuration of Image Forming Apparatus]

Figure 1:
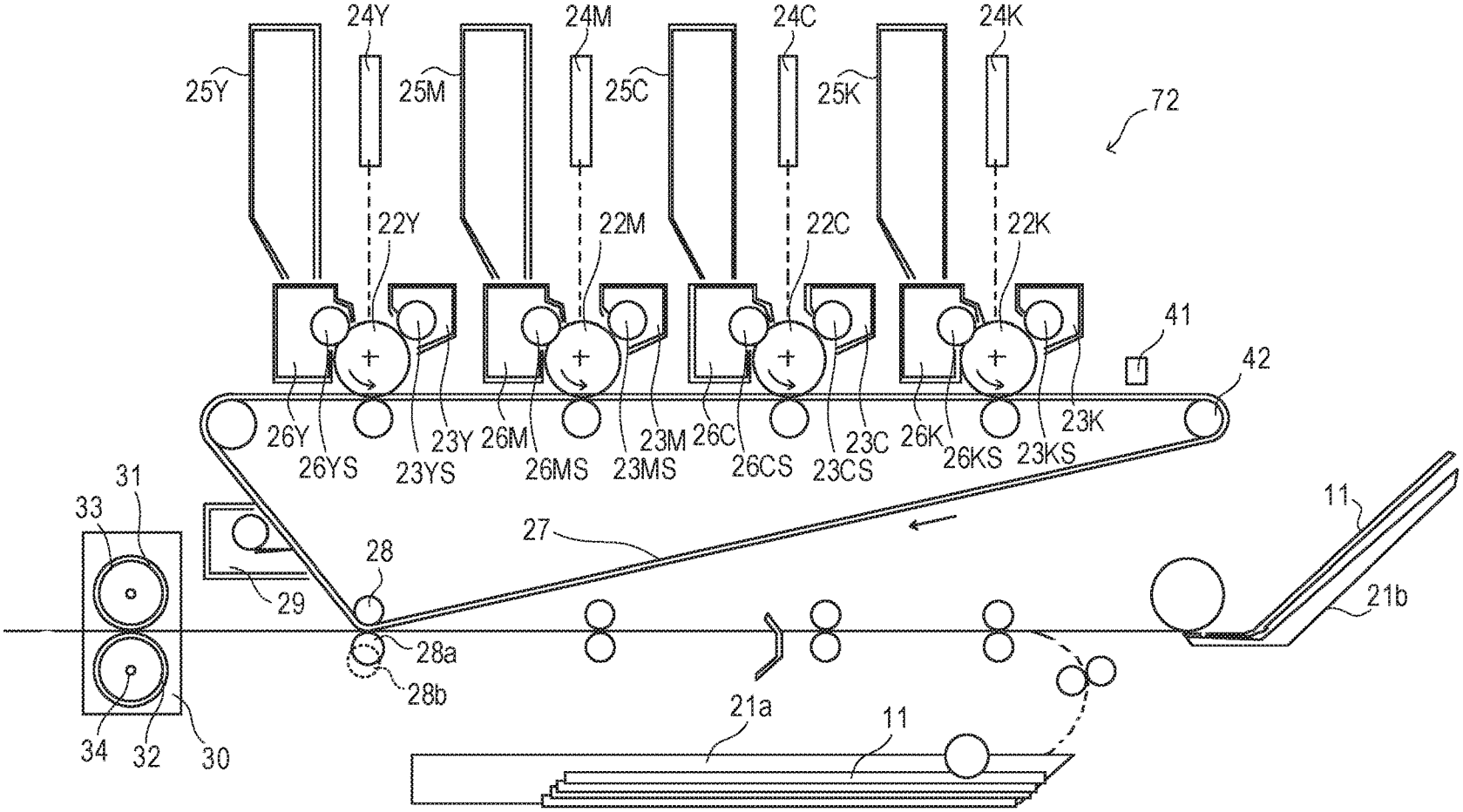
FIG. 1 is a cross-sectional view illustrating a configuration of an image forming apparatus in embodiments 1 to 3.

FIG. 1 is a cross-sectional view illustrating a configuration of a color image forming apparatus 72 (hereafter, referred to as an image forming apparatus 72) in an embodiment 1. As illustrated in FIG. 1, the image forming apparatus 72 includes four process stations comprising an image forming unit. The four process stations are disposed along a rotation direction of an endless intermediate transfer belt 27 (clockwise direction) in an order of yellow (Y), magenta (M), cyan (C), and black (K) from the left of the drawing. Indices Y, M, C, K for reference characters in the drawing indicate configurations corresponding to yellow (Y), magenta (M), cyan (C), and black (K), respectively. Note that the indices for the reference characters will be omitted below except in a case where a specified photosensitive drum or the like is referred to.

Next, an image forming operation by the image forming apparatus 72 will be described. A transfer material 11, being a recording medium, is fed from a feeding cassette 21*a* or a manual feeding tray 21*b*. Photosensitive drums 22, being photosensitive members, are each formed by applying an organic photoconductive layer on an outer circumference of an aluminum cylinder and configured to be driven by a drive motor (not illustrated) to rotate. Charging devices 23 each include a charge sleeve 23S, with which a surface of a photosensitive drum 22 is charged to have a certain potential. Next, exposure devices 24 each emit a light beam to which a surface of a photosensitive drum 22 is to be exposed (illustrated by a dash-dot line in the drawing), and the surface of the photosensitive drum 22 is exposed to the light beam. This exposure forms an electrostatic latent image on the surface of the photosensitive drum 22. The photosensitive drums 22 each rotate with a constant eccentric component (speed variation). At a timing when an electrostatic latent image is formed, a phase relation between the photosensitive drums 22 is adjusted so that eccentricity influences become the same at a transfer roller 28. Developing devices 26 each include a developing sleeve 26S. Via the developing sleeve 26S, a recording material (toner) supplied from a toner cartridge 25 is adhered to the electrostatic latent image formed on the photosensitive drum 22. The electrostatic latent image is thereby developed. The developing devices 26 are attached to the image forming apparatus 72 such as to be detachable.

The intermediate transfer belt 27, being an image bearing member, is in contact with the photosensitive drums 22. In image formation, the intermediate transfer belt 27 rotates in a clockwise direction by an intermediate-transfer-belt driving roller 42. At that time, on the intermediate transfer belt 27, monochrome toner images are transferred from the photosensitive drum 22 and superimposed on one another, so to be formed into a multicolored toner image. Being sandwiched between the intermediate transfer belt 27 and a transfer roller 28, the fed transfer material 11 is conveyed, so that the multicolored toner image formed on the intermediate transfer belt 27 is transferred on the transfer material 11. The transfer material 11 is then conveyed to a fixing device 30. During the image formation in which the toner image is transferred on the transfer material 11, the transfer roller 28 moves to a position 28*a* in the drawing to come into contact with the transfer material 11 (illustrated by a solid line). After the image formation is ended, the transfer roller 28 moves to a position 28*b* to be separated from the transfer material 11 (illustrated by a broken line).

As illustrated in FIG. 1, the fixing device 30 includes a fix roller 31 configured to heat the transfer material 11 and a pressure roller 32 configured to press the transfer material 11 against the fix roller 31. The fix roller 31 and the pressure roller 32 are both formed into a hollow shape and include built-in heaters 33 and 34, respectively. The fixing device 30 is configured to heat and press the conveyed transfer material 11, so as to melt the multicolored toner image transferred from the intermediate transfer belt 27 and fix the multicolored toner image to the transfer material 11. The transfer material 11 with the multicolored toner image fixed is then ejected by an ejecting roller (not illustrated) to an ejecting tray (not illustrated), and the image forming operation ends. A cleaning portion 29 is a device configured to remove toner not transferred on the transfer material 11 but left on the intermediate transfer belt 27. The removed toner is stored in a cleaner container. A density sensor 41 includes a detecting face opposing to the intermediate transfer belt 27, the detecting face being configured to detect reflection light. The density sensor 41 is configured to apply a light beam to a toner patch, which is a test image formed on a surface of the intermediate transfer belt 27, and configured to measure a density of the toner patch based on a light amount of reflection light from the surface of the intermediate transfer belt 27 and a light amount of reflection light from the toner patch.

[Configuration of Density Sensor]

Figure 2:
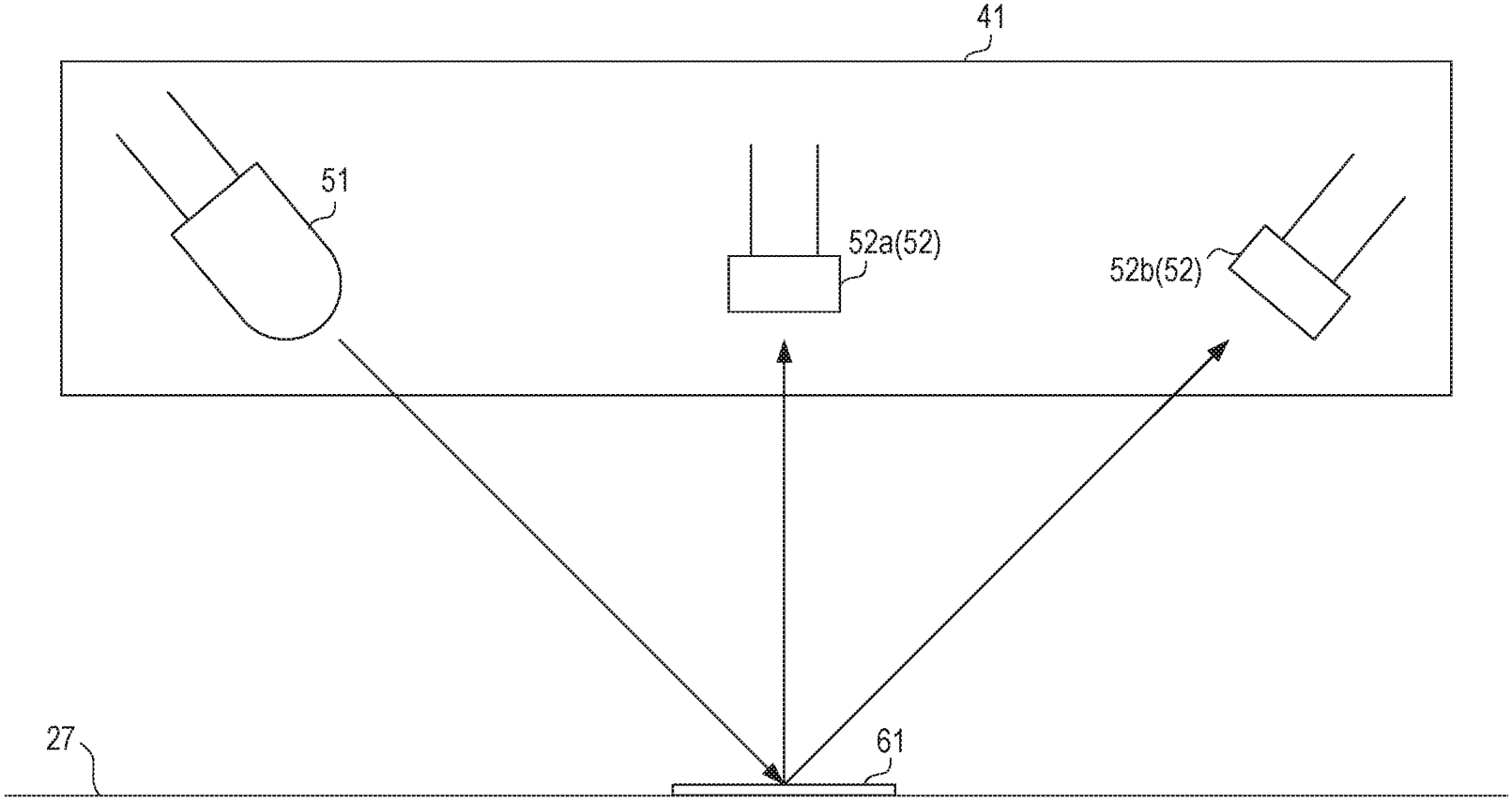
FIG. 2 is a diagram illustrating a configuration of a density sensor in the embodiments 1 to 3.

FIG. 2 is a diagram illustrating a configuration of the density sensor 41, being a detecting unit of the present embodiment. As illustrated in FIG. 2, the density sensor 41 includes a light emitting device 51 configured to emit a light beam, such as an LED, a light receiving device 52 configured to detect a light amount of reflection light of the light beam emitted from the light emitting device 51, such as a detect photo diode, and an IC (not illustrated) configured to control the light emitting device 51 and the light receiving device 52. The light-emitting device 51 is configured to apply a light beam to the intermediate transfer belt 27 and a patch 61 for a density measurement, which is a light emitted portion formed on the intermediate transfer belt 27 (hereafter, also referred to as a patch image 61, or simply a patch). The light receiving device 52 is configured to receive reflection light from the intermediate transfer belt 27 or the patch 61 to detect a light amount of the reflection light. The light receiving device 52 includes a light receiving element 52*a* configured to detect a light amount of irregular reflection light, and a light receiving element 52*b* configured to detect a light amount of regular reflection light. The two light receiving elements 52*a* and 52*b* enable detection of both of the light amount of the regular reflection light and the light amount of irregular reflection light, enabling a density of a toner patch over a range of high density to low density.

[Configuration of Control Unit of Image Forming Apparatus]

Figure 3:
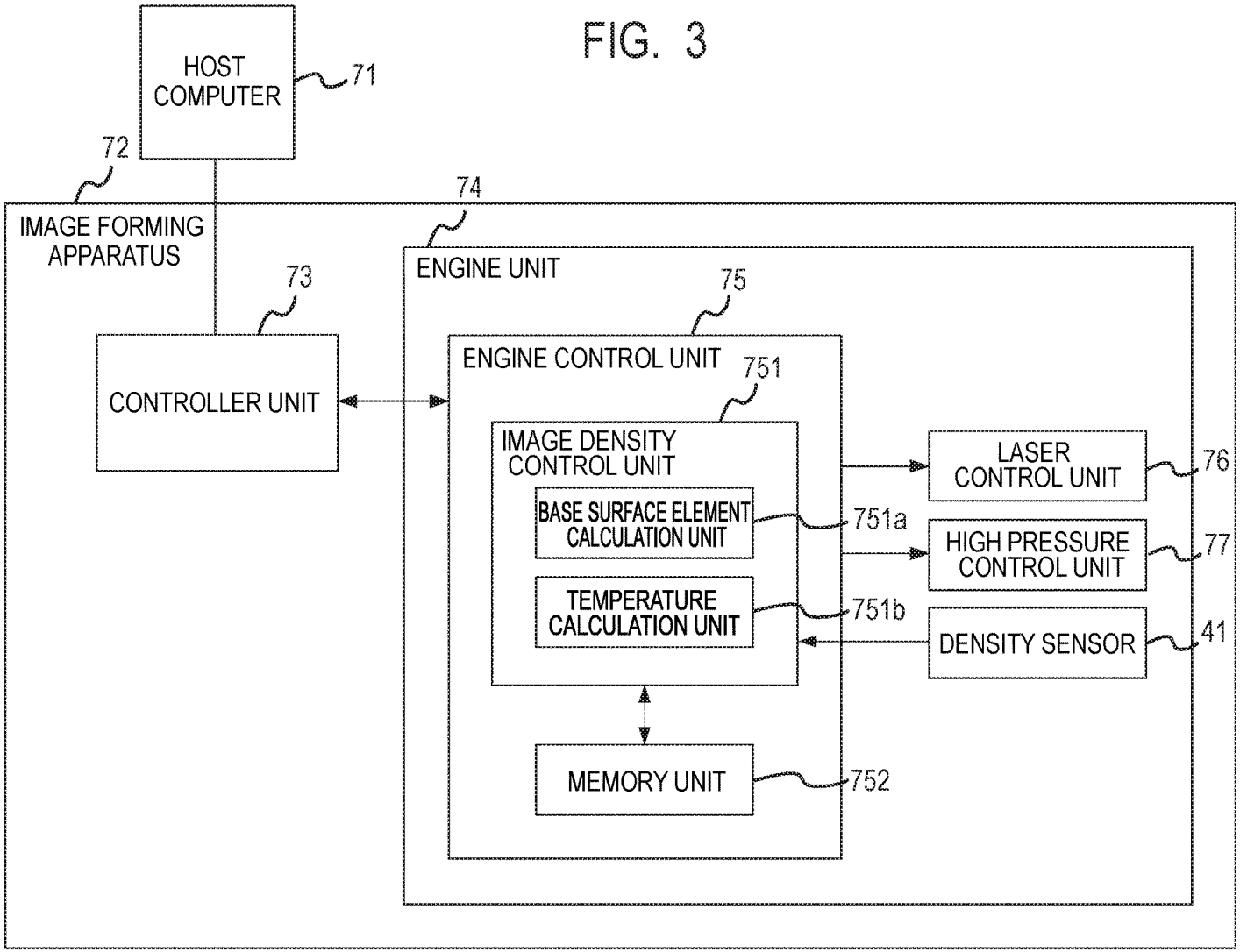
FIG. 3 is a functional block diagram of the image forming apparatus in embodiments 1 to 3.

FIG. 3 is a block diagram illustrating a configuration of a control unit of the image forming apparatus 72 in the present embodiment. The image forming apparatus 72 includes a controller unit 73 and an engine unit 74. The controller unit 73 is configured to convert image data received from a host computer 71, to generate image information used for emitting a laser light from the exposure devices 24. The engine unit 74 is configured to perform the image forming operation described above to form an image on the transfer material 11. The engine unit 74 is also configured to form a toner patch image for density measurement for each color based on the image information from the controller unit 73, and to perform image density control based on results of the density measurement made on the formed toner patch images.

The engine unit 74 includes an engine control unit 75, which is control unit configured to control various operations, a laser control unit 76 configured to control amounts of light of laser light to be emitted from the exposure devices 24, a high pressure control unit 77 configured to control high voltages to be applied to the charging devices 23, the developing devices 26 and the like, and the density sensor 41. The density sensor 41 is configured to detect a light amount of reflection light from the patch image and the intermediate transfer belt 27. Results of the detection are saved in a memory unit 752 by an image density control unit 751. In a base surface element calculation unit 751*a*, the light amount of reflection light from the intermediate transfer belt 27 is calculated based on results of density detection. In a density calculating unit 751*b*, a density of a patch image is calculated based on the light amount of reflection light from the patch image detected by the density sensor 41 and based on the light amount of reflection light from the intermediate transfer belt 27 calculated by the base surface element calculation unit 751*a*. The calculated density of the patch image is then fed back to a light emission amount of laser light controlled by the laser control unit 76 and a value of voltage to be applied to the high pressure control unit 77 to be reflected to process forming conditions for the image formation. In this manner, a maximum density and a halftone property of toner of each color are adjusted.

[Patch for Density Measurement]

Figure 4E:
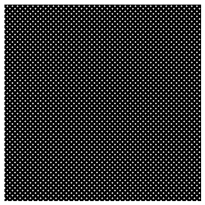
FIGS. 4A, 4B, 4C, 4D and 4E are diagrams illustrating an example of patches for a density measurement in the embodiments 1 to 3.
Figure 4D:
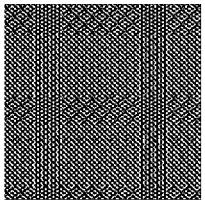
Figure 4C:
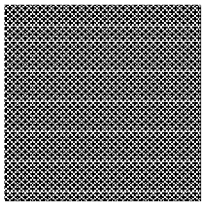
Figure 4B:
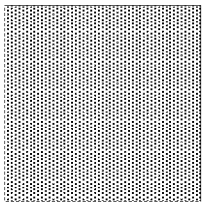
Figure 4A:
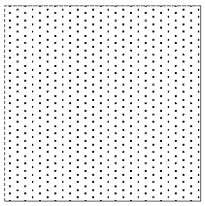

FIG. 4A to FIG. 4E are diagrams illustrating an example of toner patches for a density measurement in the present embodiment. Of the drawing, FIG. 4A illustrates an example of a toner patch with an image density of 20%, FIG. 4B illustrates an example of a toner patch with an image density of 40%, FIG. 4C illustrates an example of a toner patch with an image density of 60%, FIG. 4D illustrates an example of a toner patch with an image density of 80%, and FIG. 4E is an example of a toner patch with an image density of 100% (solid fill image). A number and kinds of the toner patches are not limited to the example illustrated in FIG. 4A to FIG. 4E, and may be changed according to a peripheral length of the intermediate transfer belt 27, a time taken for density control, a required accuracy, and the like.

[Control Sequence of Image Density Control]

Figure 5:
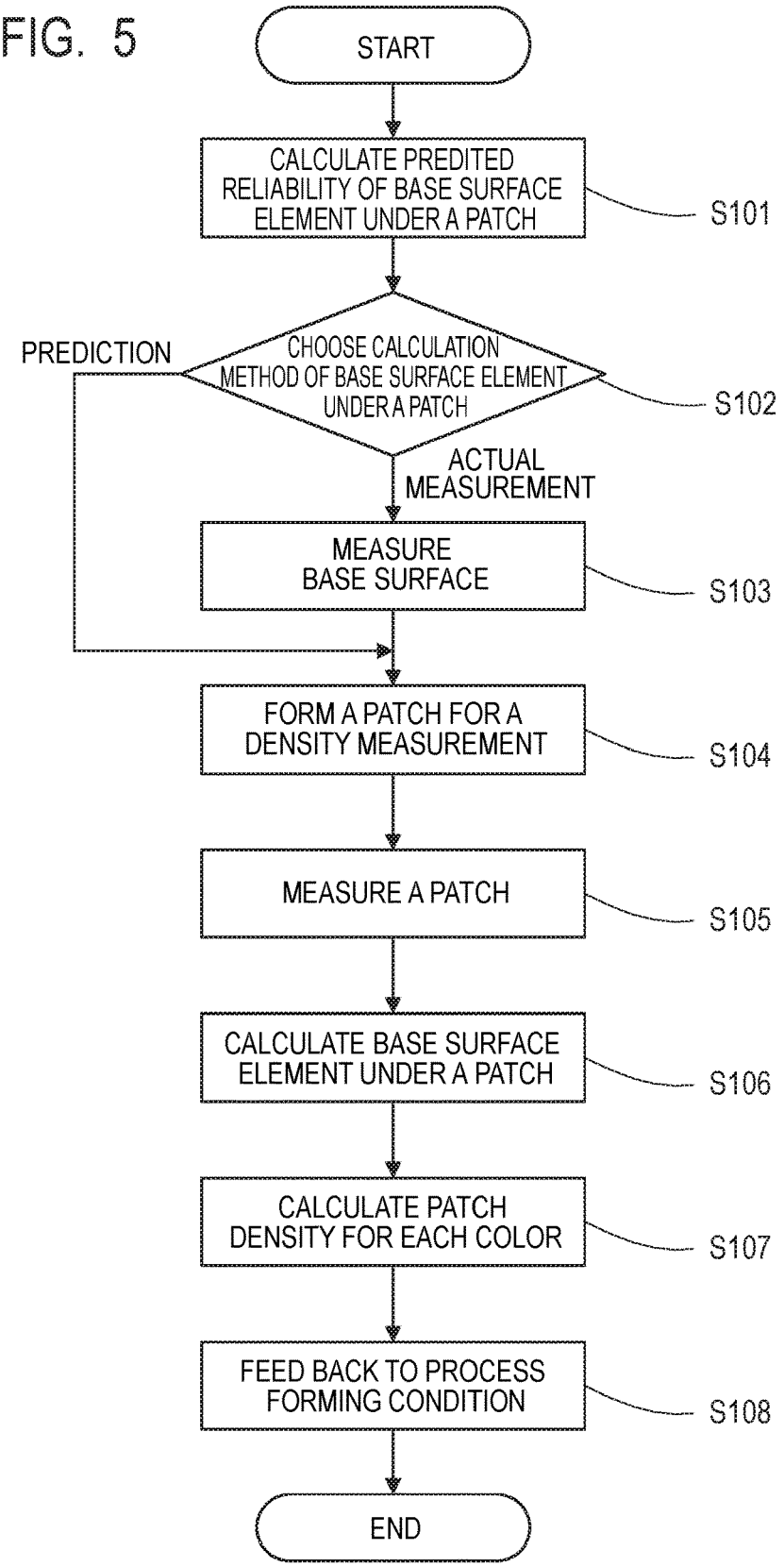
FIG. 5 is a flowchart of a density control in the embodiments 1 to 3.

FIG. 5 is a flowchart illustrating a control sequence of image density control in the present embodiment. Processing illustrated in FIG. 5 is performed by the engine control unit 75 illustrated in FIG. 3 in a case of measuring image densities. In step 101 of FIG. 5 (hereafter, step will be abbreviated to S), the engine control unit 75 calculates a predicted reliability of a base surface element under a patch. The predicted reliability indicates a reliability of a predicted value obtained by calculating a light amount of reflection light from the intermediate transfer belt 27 being the base surface element under a patch according to predictions. A specific calculation method of the predicted reliability of a base surface element under a patch will be described later. Next, in S102, the engine control unit 75 determines a calculation method of the base surface element under a patch based on the predicted reliability of the base surface element under a patch calculated in S101. When the calculated predicted reliability of the base surface element under a patch is not more than a threshold value, and the engine control unit 75 thus determines that it is necessary to apply a light beam to the intermediate transfer belt 27 being the base surface element under a patch for a measurement of a light amount of reflection light from the intermediate transfer belt 27 (actual measurement), the engine control unit 75 advances the processing to S103. When the calculated predicted reliability of the base surface element under a patch is more than the threshold value, and the engine control unit 75 thus determines that the measurement of the light amount of the reflection light from the base surface element under a patch is unnecessary (prediction), the engine control unit 75 advances the processing to S104. In S103, the engine control unit 75 uses the density sensor 41 to cause the light emitting device 51 of the density sensor 41 to apply a light beam to a reference position on the intermediate transfer belt 27 and cause the light receiving device 52 to measure a light amount of reflection light being the light beam reflected on a surface of the intermediate transfer belt 27 (second acquisition unit). The engine control unit 75 then saves light amount data of the measured reflection light in the memory unit 752 in a form of measurement data of the base surface element.

In S104, the engine control unit 75 performs the image forming operation described above to form a patch for a density measurement on a predetermined position on the intermediate transfer belt 27. In S105, the engine control unit 75 uses the density sensor 41 to cause the light emitting device 51 of the density sensor 41 to apply a light beam to the patch image for a density measurement and cause the light receiving device 52 to measure a light amount of reflection light being the light beam reflected on the patch image (first acquisition unit). The engine control unit 75 then saves light amount data of the reflection light measured by the density sensor 41 in the memory unit 752 in a form of patch measurement data. In addition, the engine control unit 75 uses the density sensor 41 to measure a light amount of reflection light being a light beam applied to the intermediate transfer belt 27 and reflected on the surface of the intermediate transfer belt 27, the surface also including positions near the patch for a density measurement. The engine control unit 75 then saves the measurement data including near-patch measurement data, in the memory unit 752.

In S106, the engine control unit 75 uses the calculation method of the light amount of reflection light from the base surface element under a patch determined in S102 to calculate the light amount of reflection light from the base surface element corresponding to a position on the intermediate transfer belt 27 where the patch image is formed. The engine control unit 75 determines the calculated light amount of reflection light from the base surface element as under-patch base surface data. That is, when determining in S102 that the measurement of the light amount of reflection light from the intermediate transfer belt 27 is necessary, the engine control unit 75 determines the light amount data measured in S103 on the reflection light from the intermediate transfer belt 27 at the position where the patch image is formed, as the under-patch base surface data. When determining in S102 that the measurement of the light amount of reflection light from the base surface element under the patch by the actual measurement is unnecessary, the engine control unit 75 determines the light amount of the reflection light from the intermediate transfer belt 27 calculated based on the measurement data at the position nearest to the patch measured in S105 as the under-patch base surface data. A specific calculation method of the under-patch base surface data from near-patch measurement data will be described later.

In S107, the engine control unit 75 calculates a density of the patch image for a density measurement (patch density) based on the under-patch base surface data calculated in S106 and the light amount of reflection light contained in the patch measurement data acquired in S105. That is, the light amount of reflection light contained in the patch measurement data acquired in S105 is the light amount of the reflection light in a state where the patch image (toner image) is formed on the base surface (intermediate transfer belt 27) (the light amount of reflection light of (base surface+toner image)). The under-patch base surface data calculated in S106 is the light amount of reflection light from a base surface (intermediate transfer belt 27) where no toner image is formed. The density of the patch for a density measurement image (patch density) (base surface+toner image) is determined by offsetting the light amount of reflection light from the base surface (intermediate transfer belt 27) from the light amount of the reflection light. Therefore, the patch density is calculated from a difference between the light amount of reflection light in the patch measurement data acquired in S105 and the under-patch base surface data calculated in S106, or from a ratio obtained by dividing the light amount of reflection light in the patch measurement data acquired in S105 by the under-patch base surface data calculated in S106. In S108, the engine control unit 75 gives feedback to the process forming conditions based on the calculated patch density. A base surface compensation process described previously is a process included in a process of S107 described above.

[Calculation of Predicted Reliability of Base Surface Element Under Patch]

Figure 6:
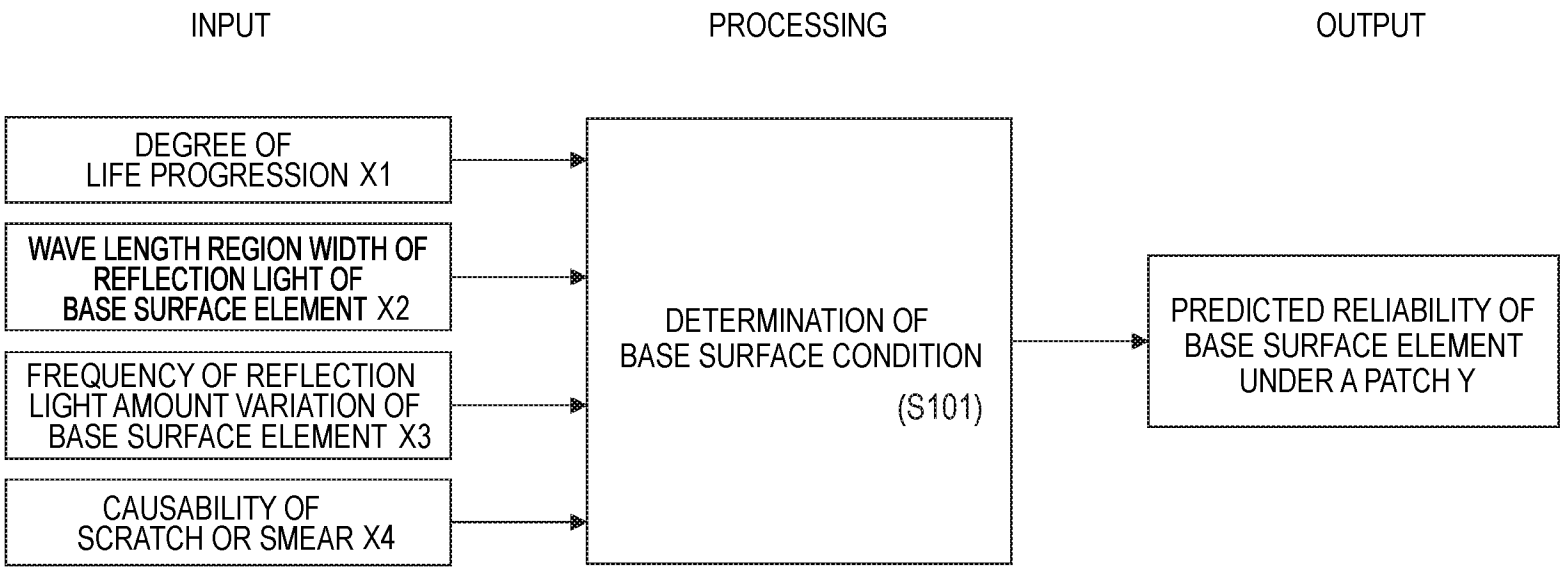
FIG. 6 is a diagram illustrating a calculation process for a predicted reliability of a light amount of reflection light in the embodiment 1.

FIG. 6 is a diagram illustrating the process in S101 of FIG. 5 described above for calculating a reliability of a predicted value of a light amount of reflection light from the intermediate transfer belt 27 where the patch for a density measurement is formed ("determination of base surface condition"). Based on results calculated by a calculation process of the predicted reliability of the base surface element under a patch, the calculation method of the base surface element under a patch in S102 of FIG. 5 is selected. As illustrated in FIG. 6, four input parameters X1 to X4 are used in the calculation process for the predicted reliability of the base surface element under a patch in the present example. A degree X1 of life progression is a first parameter indicating a value corresponding to an elapsed time from a start of use of the intermediate transfer belt 27. A wavelength region width X2 of reflection light of a base surface element is a second parameter indicating a value corresponding to a difference between a maximum light amount value and a minimum light amount value (a variation amount) of a light amount of reflection light applied to the intermediate transfer belt 27, over an entire periphery of the light beam, the intermediate transfer belt 27 being a base surface element. A frequency X3 of the variation amount of the light amount of reflection light from the base surface element is a third parameter indicating a value corresponding to a tendency of changes in the light amount of reflection light being a light beam applied to the intermediate transfer belt 27 (variation tendency). For example, the frequency X3 is defined to be low in a case where the surface of the intermediate transfer belt 27 is smooth, and the changes in the light amount of the reflection light are small (within a predetermined range), and the frequency X3 is defined to be high in a case where the surface of the intermediate transfer belt 27 is not smooth, and the changes in the light amount of the reflection light are larger than the predetermined range. A causability X4 of scratch or smear is a fourth parameter indicating a value corresponding to a causability of a scratch or smear occurring on the surface of the intermediate transfer belt 27 attributable to, for example, a material used or the like (proneness of the occurrence). A process of S101 includes calculation of the predicted reliability Y of the base surface element under a patch using the parameter X1 to X4 described above.

Assume a case where the time from the start of use of the intermediate transfer belt 27 becomes long, and the degree X1 of life progression becomes high. In such a case, in general, a calculation accuracy of the under-patch base surface data by prediction becomes low as the values of the wavelength region width X2 and the frequency X3 of the reflection light from the base surface element increases, and the causability X4 of scratch or smear increases. Hence, in the present embodiment, the following formula (1) is used to calculate a predicted reliability Y of a case where the light amount of reflection light from the base surface element under a patch is calculated according to predictions. In other words, the predicted reliability Y can be a determination value for determination of a surface condition of the intermediate transfer belt 27.

$$Y=\alpha(1-X1)+\beta(1-X2)+\gamma(1-X3)+\delta(1-X4) \quad (1)$$

In Formula (1), the input parameters X1 to X4 are given values ranging from 0 to 1 according to the degree of life progression (X1), the wavelength region width (X2) and the frequency (X3) of reflection light of the base surface element, and the causability of scratch or smear (X4). The engine control unit 75 is supposed to set the values of the input parameters X1 to X4 to the memory unit 752 at any timing before performing the density control, such as power-on, preparing operation for printing, postprocessing operation of printing, and factory shipment. For example, as to the degree X1 of life progression X1, data given a value ranging from 0 to 1 according to an operating time of the intermediate transfer belt 27 is written in the memory unit 752. The engine control unit 75 stores the value of X1 according to a measured operating time in the memory unit 752. As to the wavelength region width X2 of reflection light of the base surface element and the frequency X3 of reflection light amount variation of the base surface element, the engine control unit 75 determines values of X2 and X3 by determining the wavelength region width of reflection light of the base surface element and the frequency based on latest measurement data obtained by measuring the light amount of reflection light from the patch for a density measurement, and stores the values in the memory unit 752. Kinds and a number of the input parameters, and the timing for storing the input parameters in the memory unit 752 are not limited to what are described in the present embodiment.

Coefficients α, β, γ, δ in Formula (1) can be set according to a degree of influence on the predicted reliability Y within ranges within which a relation of Formula (2) shown below is satisfied.

$$\alpha+\beta+\gamma+\delta=1 \quad (2)$$

The predicted reliability Y calculated from Formulae (1), (2) is a value satisfying $0<Y<1$. The predicted reliability Y coming closer to 1 indicates a higher accuracy of the calculation of the under-patch base surface data by prediction, that is, the light amount data of reflection light from the intermediate transfer belt 27.

Table 1 shown below is a table listing values of the coefficients α, β, γ, δ in the present embodiment. In Table 1, a left column shows kinds of the coefficients α, β, γ, δ, a center column shows values of the coefficients α, β, γ, δ, and a right column shows the input parameters influenced by the coefficients α, β, γ, δ. Coefficient values shown in Table 1 are set at values on an assumption that the value of the wavelength region width X2 or the frequency X3 of reflection light of the base surface element has a higher influence on a prediction accuracy of the light amount of the reflection light than variations in the base surface element (intermediate transfer belt 27) of which a durability life progresses with an operating time of the intermediate transfer belt 27. The coefficients α, β, γ, δ may be set as fixed values as shown in Table 1 or may be changed according to temperature or humidity. That is, the coefficients α, β, γ, δ of the input parameters X1 to X4 may be dynamically adjusted according to temperature or humidity of a usage environment measured by an environment sensor (not illustrated) provided in the image forming apparatus 72.

TABLE 1

| COEFFICIENT | VALUE | INFLUENCE |
|---|---|---|
| α | 0.15 | DEGREE X1 OF LIFE PROGRESSION |
| β | 0.3 | WAVELENGTH REGION WIDTH X2 OF REFLECTION LIGHT OF BASE SURFACE ELEMENT |
| γ | 0.4 | FREQUENCY X3 OF REFLECTION LIGHT AMOUNT VARIATION OF BASE SURFACE ELEMENT |
| δ | 0.15 | CAUSABILITY X4 OF SCRATCH OR SMEAR |

[Selecting Calculation Method of Light Amount of Reflection Light from Base Surface Element Under Patch]

In the present example, a process of S102 of FIG. 5 includes determination as to whether the light amount of reflection light from the base surface element under a patch is to be actually measured or calculated according to predictions, according to the predicted reliability Y of the base surface element under a patch calculated in the process of S101. In the present example, the predicted reliability Y of the base surface element under a patch calculated in the process of S101 is used to determine Formula (3) shown below. When the predicted reliability Y of the base surface element under a patch satisfies Formula (3), the calculation of the light amount of reflection light from the base surface element under a patch by prediction is determined to be feasible, and an actual measurement is not performed. When the predicted reliability Y of the base surface element under a patch calculated in the process of S101 does not satisfy Formula (3), the light amount of reflection light from the base surface element under a patch is actually measured.

$$Y>P \quad (3)$$

In the present embodiment, the threshold value P is set at a fixed value, 0.7. Although the threshold value P is assumed to be a fixed value in the present example, the threshold value P may be adjusted according to, for example, an environment temperature or an environment humidity measured by the environment sensor (not illustrated). For example, at a high environment temperature, the intermediate transfer belt 27 may expand to have a wavy surface. If the intermediate transfer belt 27 has such a surface, a difference between a large light amount and a small light amount of reflection light from the intermediate transfer belt 27 (wavelength region width X2) increases, or variations in the light amount of the reflection light become inconsistent and significantly change (the frequency X3 increases). Therefore, for example, the coefficient β of the wavelength range width X2 or the coefficient γ of the frequency X3 may be changed to change weighing for calculating the predicted reliability Y.

[Calculating Light Amount of Reflection Light from Base Surface Element Under Patch]

Here, description will be made about a calculation process of S106 of FIG. 5 for the light amount of reflection light from the base surface element under a patch. As described above, calculation methods of the light amount of reflection light from the intermediate transfer belt 27, being the base surface element under a patch, include two: a calculation method by actual measurement and a calculation method by prediction.

To calculate the light amount of the reflection light by actual measurement, the light amount of the reflection light is measured over an entire periphery of the surface of the intermediate transfer belt by the density sensor 41, prior to formation of a patch for a density measurement, so that the measurement data of base surface element is obtained, which is saved in the memory unit 752. Of measurement data items on base surface element saved in the memory unit 752, a measurement data item on base surface element is referenced to, the measurement data item being of the same position on the intermediate transfer belt 27 as a position where the patch for a density measurement is formed, so that the under-patch base surface data is determined. The under-patch base surface data is light amount data of the reflection light from the intermediate transfer belt 27 where the patch is formed.

Figure 7:
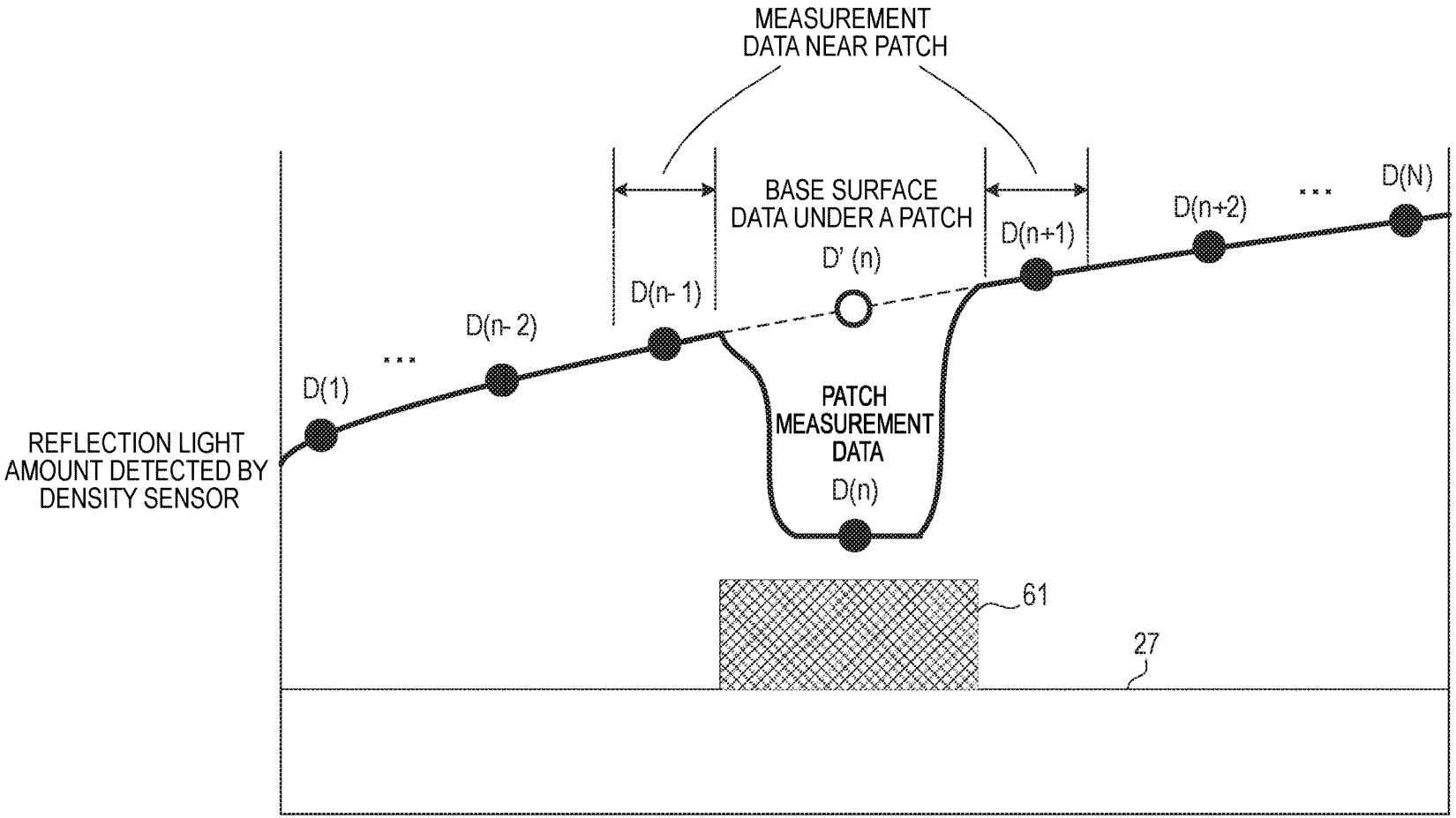
FIG. 7 is a diagram illustrating a calculation method of a light amount of reflection light from a base surface element under a patch in the embodiment 1.

To calculate the light amount of the reflection light by prediction, the light amount of the reflection light from the surface of the intermediate transfer belt 27 near a patch image for a density measurement, that is, the near-patch measurement data described above, is used to calculate the light amount of the reflection light from the base surface element under a patch. FIG. 7 is a diagram illustrating a method for calculating the light amount of reflection light from the base surface element under a patch, by prediction. FIG. 7 is a diagram in which light amounts of reflection light beams are plotted, the light amounts being obtained when the patch image 61 for a density measurement formed on the intermediate transfer belt 27 is measured by the density sensor 41. A vertical axis represents light amount of reflection light detected by the density sensor 41, and a horizontal axis represents position on the intermediate transfer belt 27 in a circumferential direction. In FIG. 7, D(1) to D(N) illustrated by black dots represent light amounts of reflection light beams from the intermediate transfer belt 27 or the patch image 61 for a density measurement measured by the density sensor 41. D(n) represents a light amount of reflection light from the patch image 61 for a density measurement formed at a first position. D(n−1) and D(n+1) represent light amounts of reflection light beams at a second position and a third position, respectively, near the patch. The light amounts are measured at timings before and after the measurement of the light amount of reflection light from the patch image 61 for a density measurement. A graph of the light amounts of reflection light beams from the intermediate transfer belt 27 in the present embodiment illustrated in FIG. 7 is drawn as a line extending with a constant displacement amount. A case where light amounts of reflection light beams are depicted in a line extending with a constant displacement amount is considered as a low frequency X3 of reflection light amount variation of the base surface element. Hence, letting D'(n) denote under-patch base surface data to be predicted, D'(n) can be determined by the following Formula (4) with D(n−1) and D(n+1) being near-patch measurement data items.

$$D'(n)=(D(n-1)+D(n+1))/2 \quad (4)$$

Formula (4) is a simplest linear interpolation formula for determining an average value of data items D(n−1) and D(n+1) representing light amounts of reflection light beams from the intermediate transfer belt 27, being near-patch measurement data items measured at timings before and after the timing of the data D(n) obtained by measuring the light amount of reflection light from the patch image 61. In place of such a linear interpolation for determining the average value over the two positions, use may be made of a linear interpolation in which, for example, weighing is performed according to distances from near-patch measurement data items. In S107 of FIG. 5, the patch density is calculated using the light amount of reflection light from the intermediate transfer belt 27 determined by actual measurement, or the light amount of reflection light from the patch image 61 for a density measurement calculated from the near-patch measurement data.

As described above, in the present example, the predicted reliability of the base surface element under a patch is calculated from the surface condition of the intermediate transfer belt, and according to a result of the calculation, the calculation method of the light amount of reflection light from the base surface element under a patch is selected. When the selected calculation method is the method for calculating the light amount of the reflection light by prediction, the process of measuring the light amount of reflection light from the base surface element can be omitted, so that the time taken for the density measurement of the patch can be reduced. In addition, the density measurement is performed based on the predicted reliability of the base surface element under a patch calculated from the surface condition of the intermediate transfer belt, so that an accuracy of the density measurement can be maintained.

As seen from the above, according to the present embodiment, it is possible to reduce the time taken for the density measurement of the patch while maintaining the accuracy of the measurement.

Embodiment 2

In Embodiment 1, the description is made about an embodiment in which the light amount of reflection light from the base surface element under a patch (intermediate transfer belt) is calculated by prediction, using the calculation method performing the linear interpolation on the near-patch measurement data. However, in a case where the wavelength range width of reflection light of the base surface element of the intermediate transfer belt is large, or a case where the frequency of variation amount of the light amount of reflection light of the base surface element is high, the light amount of the reflection light may significantly change during a sampling period for measuring the light amount of the reflection light. As a result, an accuracy of the light amount of reflection light of the base surface element under a patch calculated by prediction may decrease. Hence, in Embodiment 2, description will be made about an embodiment in which, to calculate the light amount of reflection light of the base surface element under a patch by prediction, the method for calculating the light amount of reflection light of the base surface element under a patch is switched according to the surface condition of the intermediate transfer belt. It should be noted that the configuration of the image forming apparatus and the configurations of the control unit and the like for controlling the image forming apparatus are the same as in Embodiment 1. Therefore, the same components will be denoted by the same reference characters and will not be described here.

[Calculating Light Amount of Reflection Light from Base Surface Element Under Patch]

Figure 8:
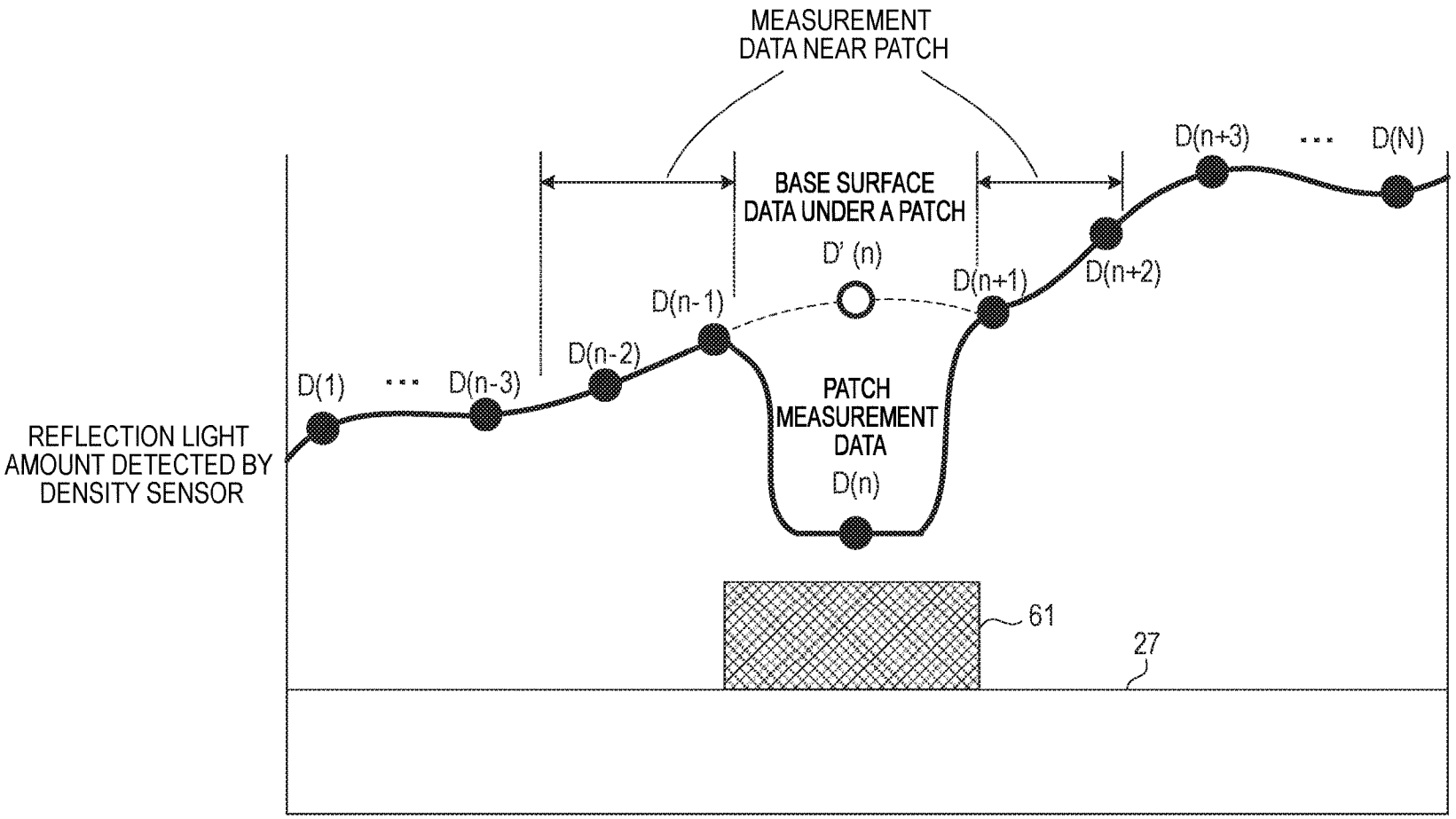
FIG. 8 is a diagram illustrating a calculation method of a light amount of reflection light from a base surface element under a patch in the embodiment 2.

FIG. 8 is a diagram illustrating a method for calculating a light amount of reflection light in a case where a frequency of variation amount of reflection light of base surface element of the intermediate transfer belt 27 in the present embodiment is high, that is, in a case where variations in the light amount of reflection light are so large that the variations are depicted as not a line but a curve. FIG. 8 is a diagram in which, as in FIG. 7 in Embodiment 1, light amounts of reflection light beams are plotted, the light amounts being obtained when the patch image 61 for a density measurement formed on the intermediate transfer belt 27 is measured by the density sensor 41. A vertical axis represents light amount of reflection light detected by the density sensor 41, and a horizontal axis represents position on the intermediate transfer belt 27 in a circumferential direction. In FIG. 8, D(1) to D(N) illustrated by black dots represent light amounts of reflection light beams from the intermediate transfer belt 27 or the patch 61 for a density measurement measured by the density sensor 41. D(n) represents a light amount of a reflection light beam from the patch for a density measurement. D(n−2), D(n−1), D(n+1), D(n+2) represent light amounts of reflection light beams measured near the patch. The light amounts are measured at timings before and after the measurement of the light amount of reflection light from the patch for a density measurement. The graph of the light amounts of reflection light beams from the intermediate transfer belt 27 illustrated in FIG. 7 in Embodiment 1 is a linear graph extending with a constant displacement amount. In contrast, in FIG. 8 in the present example, a width of a magnitude of the light amount of reflection light of the intermediate transfer belt 27 (wavelength range width X2 of the base surface element) is large, and variation amounts of the measured light amounts of reflection light beams at adjacent sampling locations are uneven. Therefore, the graph obtained by plotting the light amounts of reflection light beams is drawn as a curve. As a result, the calculation of the light amount of reflection light of the intermediate transfer belt 27 at the position where the patch image 61 for a density detection by the linear interpolation, which is performed with precision in Embodiment 1, is difficult. Therefore, in such a case, it is desirable that a number of near-patch measurement data items used for the calculation is increased and that a calculation method enabling a prediction for a curve is used.

Hence, in the present example, a sampling frequency of near-patch measurement data items and a kind of a prediction method used for the calculation of the light amount of reflection light of the base surface element under a patch by prediction are switched according to the wavelength range width X2 and the frequency X3 of the base surface element of the intermediate transfer belt 27. Specifically, when the wavelength range width X2 (variation amount) of the light amount of reflection light over the entire periphery of the intermediate transfer belt 27 being the base surface element is larger than a predetermined value (predetermined variation amount), there is a possibility that variations in the light amount of reflection light at positions near the position on the intermediate transfer belt 27 where the patch for a density measurement image is formed are large. Therefore, to improve a reliability of prediction data based on the near-patch measurement data, a sampling frequency for a near-patch measurement data segment (detection cycle) is set to be high, so as to increase a number of measurements of the light amount of reflection light. For example, in FIG. 7 in Embodiment 1, acquisition of the near-patch measurement data is performed once each before and after the measurement at the patch 61 for a density measurement. However, in FIG. 8 in the present example, the acquisition is performed twice ((D(n−2), D(n−1), D(n+1), D(n+2)) each before and after the measurement at the patch 61 for a density measurement. In addition, there is a case where variations in the light amount of reflection light at adjacent locations on the intermediate transfer belt 27 are large, that is, the frequency X3 of reflection light amount variation of the base surface element is high. Such a case is supported by using a nonlinear interpolation such as a spline interpolation using a spline curve. A degree of a polynomial used for the nonlinear interpolation can be set according to the frequency X3.

Table 2 shown below is a table summarizing sampling frequencies and prediction methods for the calculation of the light amount of reflection light of the intermediate transfer belt 27 (base surface element) where the patch for a density detection is formed, according to the surface condition of the intermediate transfer belt 27. In Table 2, a left column shows combinations of the wavelength range width X2 of the base surface element and the frequency X3 of reflection light amount variation of the base surface element, both representing the surface condition of the intermediate transfer belt 27. A right column shows sampling frequencies for measuring the light amount of reflection light near the patch according to the surface condition of the intermediate transfer belt 27 and prediction methods used for calculating the light amount of reflection light from acquired near-patch measurement data. According to Table 2, when the wavelength range width of reflection light of the base surface element (variation amount) X2 is small (not more than the predetermined variation amount), a sampling frequency is set to be low (long) near the patch, and the sampling frequency is set to be high (short) in a case where the wavelength range width X2 of the base surface element is large. In calculation of prediction data of the light amount of reflection light from Table 2, the prediction data is calculated using a linear interpolation when the frequency X3 of reflection light amount variation of the base surface element is low, and the prediction data is calculated using a nonlinear interpolation when the frequency X3 of reflection light amount variation of the base surface element is high.

TABLE 2

| SURFACE CONDITION OF INTERMEDIATE TRANSFER BELT | | REFLECTION LIGHT AMOUNT OF BASE SURFACE ELEMENT UNDER PATCH | |
|---|---|---|---|
| WAVELENGTH REGION WIDTH X2 | FREQUENCY X3 | SAMPLING FREQUENCY | PREDICTION METHOD |
| SMALL | LOW | LOW | LINEAR INTERPOLATION |
| SMALL | HIGH | LOW | NONLINEAR INTERPOLATION |
| LARGE | LOW | HIGH | LINEAR INTERPOLATION |
| LARGE | HIGH | HIGH | NONLINEAR INTERPOLATION |

In the present example, the wavelength range width of the light amount of reflection light of intermediate transfer belt 27 (the wavelength range width X2 of the base surface element) or the frequency X3 of reflection light amount variation of base surface element are used as a determination criterion for switching the sampling frequency or the prediction method. However, another determination criterion may be used. For example, the calculation method of the base surface element under a patch may be switched depending on a width of a patch formed for a density measurement or a performance of the density sensor 41 detecting the reflection light, such as resolution. For example, when the width of a patch image formed for a density measurement is small (not more than a predetermined width), the light amount of reflection light from the intermediate transfer belt 27 near the patch can be measured. Therefore, a sampling cycle can be increased, and a linear interpolation can be applied as the prediction method. In contrast, when the width of a patch image formed for a density measurement is large (larger than the predetermined width), the light amount of reflection light from the intermediate transfer belt 27 near the patch cannot be measured. Therefore, the sampling frequency is set to be low near the patch to increase a number of acquisitions of light amount data items on reflection light near the patch, and a nonlinear interpolation may be used as the prediction method in consideration of large variations in the light amount data items on reflection light. In a case where the resolution of the density sensor 41 for detecting the reflection light is low, the case may be supported by increasing the sampling frequency. In addition, as to the method of calculating the light amount of reflection light of the base surface element under a patch, a method other than the method described in the present embodiment, such as adjusting a usage segment of the near-patch measurement data, may be used.

As described above, in the present embodiment, to calculate the prediction data of the light amount of reflection light of intermediate transfer belt where the patch is formed (base surface element), the calculation method of the light amount of reflection light of the base surface element under a patch is switched according to the surface condition of the intermediate transfer belt. As a result, prediction of the light amount of reflection light with respect to the surface condition of the intermediate transfer belt is enabled. As a result, the time taken to measure the light amount of reflection light can be reduced while the accuracy of the density measurement is maintained.

As seen from the above, according to the present embodiment, it is possible to reduce the time taken for the density measurement of the patch while maintaining the accuracy of the measurement.

Embodiment 3

In Embodiment 1, to calculate prediction data of a light amount of reflection light of a base surface element of a patch formed on the intermediate transfer belt, the prediction data is calculated by a linear interpolation using near-patch measurement data collected at a predetermined sampling frequency. In Embodiment 2, the prediction data of the light amount of reflection light is calculated by switching the sampling frequency or switching the prediction method between a linear interpolation and a nonlinear interpolation according to the surface condition of the intermediate transfer belt. Application of one calculation method of the light amount of reflection light to an entire intermediate transfer belt in such a manner cannot support, for example, local variations in surface condition. Hence, in Embodiment 3, description will be made about an embodiment in which the entire periphery of the intermediate transfer belt is divided into some areas, and based on a surface condition of the intermediate transfer belt in each of the areas, the sampling frequency and the prediction method for calculating the light amount of reflection light of the base surface element where the patch is formed, are switched.

[Calculating Light Amount of Reflection Light from Base Surface Element Under Patch]

FIG. 9 is a table showing methods for calculating the light amount of reflection light of the base surface element under a patch in the present embodiment. FIG. 9 shows surface conditions of the intermediate transfer belt 27 in forms of the wavelength range width X2 and the frequency X3 of the base surface element, and the causability X4 of scratch or smear in each of four areas, an area 1 to an area 4, into which the entire periphery of the intermediate transfer belt 27 is divided. A row of calculation methods of the base surface element under a patch shows sampling frequencies of the light amount of reflection light to calculate the base surface element under a patch, and prediction methods used to calculate prediction data of the light amount of reflection light of the base surface element, according to the surface condition of the intermediate transfer belt 27 represented by the parameters X2 to X4.

With reference to FIG. 9, description will be made below about calculation method of the light amount of reflection light of the intermediate transfer belt 27 being the base surface element under a patch, in the present example. First, the entire periphery of the intermediate transfer belt 27 is divided in a plurality of areas, for example, the area 1 to the area 4. For each of the areas, the parameters X2 to X4 representing the surface condition of the intermediate transfer belt 27 are calculated. The degree X1 of life progression is omitted because X1 is a parameter used for the intermediate transfer belt 27 as a whole. The values of the parameters X1 to X4 are assumed to be set at the same timing as in Embodiment 1.

Next, based on the parameters X2 to X4 representing the surface condition of the intermediate transfer belt 27, a method to be used for calculating the light amount of reflection light of the base surface element under a patch is selected for each area. In the present embodiment, the method to be used is selected based on the criterion described in Embodiments 1, 2. For example, in FIG. 9, the sampling frequency is low (long) in the areas 1, 2 where the wavelength range width X2 of the base surface element is small, and the sampling frequency is high (short) in the area 4 where the wavelength range width X2 is large. In the area 1 where the frequency X3 of reflection light amount variation of the base surface element is low, the linear interpolation is used as the prediction method. In contrast, in the areas 2, 4 where the frequency X3 is high, a polynomial interpolation being the nonlinear interpolation is used as the prediction method. In such a manner, the base surface element under a patch in each area is calculated using a method selected for each area. Now, there is an area, such as the area 3, where the causability X4 of scratch or smear is so high that the prediction of the light amount of reflection light of the base surface element under a patch is difficult, and thus an actual measurement is needed. For such an area, the light amount of reflection light of the base surface element is actually measured, or measurement data of the base surface element measured and saved in the memory unit 752 in advance is used. Note that, the above is not applied to an area where the patch for a density measurement is not formed, and the measurement of the light amount of reflection light of the base surface element is not needed.

As described above, the present embodiment has such a feature in which the calculation method of the base surface element under a patch is switched among positions on the intermediate transfer belt, according to the surface condition of the intermediate transfer belt at specified positions. As a result, prediction adapted to local variations in the surface condition of the intermediate transfer belt is enabled. As a result, the time taken for the density measurement can be reduced while the accuracy of the measurement is maintained.

As seen from the above, according to the present embodiment, it is possible to reduce the time taken for the density measurement of the patch while maintaining the accuracy of the measurement.

[Advantageous Effect of Invention]

According to the present invention, it is possible to reduce a time taken for a density measurement of a patch while an accuracy of the measurement is maintained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-147437, filed Jul. 31, 2017, which is hereby incorporated by reference herein in its entirety.

What is claimed is:

1. An image forming apparatus comprising:

an image bearing member;

an image forming unit configured to form a patch image on the image bearing member;

a detecting unit including a light emitting unit configured to emit light toward a light emitted portion that is the image bearing member or the patch image, and a light receiving unit configured to receive reflection light from the light emitted portion;

a calculating unit configured to calculate a determination value for determining a surface condition of the image bearing member; and a controlling unit configured to determine a value regarding to a density of the patch image, based on a light amount of reflection light from the patch image formed at a first position and a light amount of reflection light from the first position on the image bearing member, wherein the controlling unit determines, based on the determination value calculated by the calculating unit, a light amount of reflection light from the first position on the image bearing member from light amounts of reflection light beams from a second position and a third position on the image bearing member where the patch image is not formed in a state in which the patch image is formed at the first position on the image bearing member, or determines the light amount of reflection light from the first position on the image bearing member by detecting the light amount of reflection light from the first position on the image bearing member with the detecting unit in a state in which the patch image is not formed at the first position on the image bearing member.

2. An image forming apparatus according to claim 1, wherein the calculating unit calculates the determination value based on a first parameter corresponding to an operating time of the image bearing member, a second parameter corresponding to a variation amount of a light amount of reflection light from a position on the image bearing member where the patch image is not formed, a third parameter corresponding to a variation tendency of the light amount of reflection light from the position on the image bearing member where the patch image is not formed, and a fourth parameter corresponding to a causability of scratch or smear of the image bearing member.

3. An image forming apparatus according to claim 2, wherein, when the determination value calculated based on the parameters and coefficients corresponding to the respective parameters is greater than a threshold value, the controlling unit determines the light amount of reflection light from the first position on the image bearing member from light amounts of reflection light beams from the second position and the third position on the image bearing member where the patch image is not formed in the state in which the patch image is formed at the first position on the image bearing member, and when the determination value is not greater than the threshold value, the controlling unit determines the light amount of reflection light from the first position on the image bearing member by detecting the light amount of reflection light from the first position on the image bearing member with the detecting unit in the state in which the patch image is not formed at the first position on the image bearing member.

4. An image forming apparatus according to claim 3, wherein when a value of the fourth parameter is greater than a predetermined value, the controlling unit determines the light amount of reflection light from the first position on the image bearing member by detecting the light amount of reflection light from the first position on the image bearing member with the detecting unit, or from a light amount of reflection light of the image bearing member detected by the detecting unit in advance, in the state where the patch image is not formed at the first position on the image bearing member.

5. An image forming apparatus according to claim 2, wherein the variation amount of the light amount of reflection light is a difference between a maximum light amount value and a minimum light amount value of a light amount of reflection light from a position on the image bearing member where the patch image is not formed.

6. An image forming apparatus according to claim 2, wherein the variation tendency of the light amount of reflection light is low when variations in light amount of reflection light from a position on the image bearing member where the patch image is not formed is depicted as a line, and high when the variations in light amount of reflection light are uneven to be depicted as a curve.

7. An image forming apparatus according to claim 2, wherein in a case in which the controlling unit determines the light amount of reflection light from the first position on the image bearing member from the light amounts of reflection light beams from the second position and the third position on the image bearing member where the patch image is not formed in the state in which the patch image is formed at the first position on the image bearing member, when a variation amount of the light amount of reflection light is greater than a predetermined variation amount, the controlling unit makes a detection cycle for the light amount of reflection light by the detecting unit shorter than a detection cycle of a case in which the variation amount of the light amount of reflection light is not more than the predetermined variation amount.

8. An image forming apparatus according to claim 2, wherein in a case in which the controlling unit determines the light amount of reflection light from the first position on the image bearing member from the light amounts of reflection light beams from the second position and the third position on the image bearing member where the patch image is not formed in the state in which the patch image is formed at the first position on the image bearing member, when a width of the patch image formed at the first position is wider than a predetermined width, the controlling unit makes a detection cycle for the light amount of reflection light by the detecting unit shorter than a detection cycle of a case in which the width of the patch image is not wider than the predetermined width.

9. An image forming apparatus according to claim 2, wherein when a resolution of the light receiving unit of the detecting unit for detecting the light amount of reflection light is low, the controlling unit makes a detection cycle for the light amount of reflection light by the detecting unit short.

10. An image forming apparatus according to claim 1, wherein in a case in which the controlling unit determines the light amount of reflection light from the first position on the image bearing member from light amounts of reflection light beams from the second position and the third position on the image bearing member where the patch image is not formed in the state in which the patch image is formed at the first position on the image bearing member, when a variation tendency of the light amount of reflection light is low, the controlling unit determines the light amount of reflection light from the first position by a linear interpolation, and when the variation tendency of the light amount of reflection light is high, the controlling unit determines the light amount of reflection light from the first position by a nonlinear interpolation.

11. An image forming apparatus according to claim 2, wherein, in a case in which the controlling unit determines the light amount of reflection light from the first position on the image bearing member from light amounts of reflection light beams from the second position and the third position on the image bearing member where the patch image is not formed in the state in which the patch image is formed at the first position on the image bearing member, when a variation tendency of the light amount of reflection light is low, the controlling unit determines the light amount of reflection light from the first position by a linear interpolation, and when the variation tendency of the light amount of reflection light is high, the controlling unit determines the light amount of reflection light from the first position by a nonlinear interpolation.

12. An image forming apparatus according to claim 1, wherein the first position on the image bearing member is a position sandwiched between the second position and the third position on the image bearing member.

13. An image forming apparatus according to claim 1, wherein the second position and the third position on the image bearing member are positions nearest the patch image across the first position where the patch image is formed, the positions being from among of positions where the patch image on the image bearing member of which the light amount of reflection light is detected by the detecting unit is not formed.

14. An image forming apparatus according to claim 2, wherein the second parameter, the third parameter, and the fourth parameter are calculated for an entire periphery of the image bearing member.

15. An image forming apparatus according to claim 2, wherein an entire periphery of the image bearing member is divided into a plurality of areas, and the second parameter, the third parameter, and the fourth parameter are calculated for each of the areas.

16. An image forming apparatus according to claim 15, wherein the controlling unit determines, according to a surface condition of the image bearing member in each area, the light amount of reflection light from the first position on the image bearing member from the light amounts of reflection light beams from the second position and the third position on the image bearing member where the patch image is not formed in the state in which the patch image is formed at the first position on the image bearing member or determines the light amount of reflection light from the first position on the image bearing member by detecting the light amount of reflection light from the first position on the image bearing member with the detecting unit in the state in which the patch image is not formed at the first position on the image bearing member.

* * * * *